US005381157A

United States Patent [19]

Shiga

[11] Patent Number: 5,381,157

[45] Date of Patent: Jan. 10, 1995

[54] MONOLITHIC MICROWAVE INTEGRATED CIRCUIT RECEIVING DEVICE HAVING A SPACE BETWEEN ANTENNA ELEMENT AND SUBSTRATE

[75] Inventor: Nobuo Shiga, Yokohama, Japan

[73] Assignee: Sumitomo Electric Industries, Ltd., Osaka, Japan

[21] Appl. No.: 875,015

[22] Filed: Apr. 28, 1992

[30] Foreign Application Priority Data

May 2, 1991 [JP] Japan ..... 3-100888
May 31, 1991 [JP] Japan ..... 3-129688

[51] Int. Cl.[6] ..... H01Q 1/38
[52] U.S. Cl. ..... 343/700 MS; 343/895
[58] Field of Search ..... 343/700 MS, 795, 895; 333/246, 247; 455/276, 281, 313, 333

[56] References Cited

U.S. PATENT DOCUMENTS

| | | | |
|---|---|---|---|
| Re. 32,369 | 3/1987 | Stockton et al. | 342/368 |
| 4,490,721 | 12/1984 | Stockton et al. | 343/700 MS |
| 4,654,622 | 3/1987 | Foss et al. | 343/700 MS |
| 5,001,493 | 3/1991 | Patin et al. | 343/700 MS |
| 5,041,839 | 8/1991 | Rees | 343/700 MS |
| 5,125,109 | 6/1992 | Geller et al. | 343/700 MS |

FOREIGN PATENT DOCUMENTS

| | | | |
|---|---|---|---|
| 193849 | 9/1986 | European Pat. Off. . | |
| 346125 | 12/1989 | European Pat. Off. . | |
| 0182203 | 9/1985 | Japan | 343/700 MS |
| 0196705 | 8/1992 | Japan | H01Q 21/24 |
| 2242316 | 9/1991 | United Kingdom . | |

OTHER PUBLICATIONS

Robert J. Mailloux, et al, "Microstrip Array Technology", IEEE Trans. Antennas Propagat., vol. AP-29, pp. 36-48 (1981).

Ito et al, "Planar Antennas For Satellite Recption", *IEEE Transactions on Broadcasting*, vol. 34, No. New York, U.S., pp. 457-464, XP000049723 (Dec. 1988).

James, et al, "Superimposed Dichroic Microstrip Antenna Arrays", *IEE Proceedings H. Microwaves, Antennas & Propagation*, vol. 135, No. 5, Stevenage GB, pp. 304-312, XP000008833, (Oct. 1988).

Kermarrec et al, "The First GaAs Fully Integrated Microwave Receiver For DBS Applications at 12 GhZ", *14th European Microwave Conference* 84, Liege, Belgium (Sep. 1984).

*Primary Examiner*—Donald Hajec
*Assistant Examiner*—Tan Ho
*Attorney, Agent, or Firm*—Beveridge, DeGrandi, Weilacher & Young

[57] ABSTRACT

The receiving device according to this invention includes one or more patch or helical antennas and one or more receiving units formed monolithically on a single substrate. In order to widen the receiving frequency band, antenna elements are formed not directly on a compound semiconductor substrate but with a space between the antenna element and the substrate. In the patch antenna embodiment, patch elements are supported by dielectric posts, whereby there is provided a void between most of the patch antenna and the underlying semiconductor substrate.

17 Claims, 13 Drawing Sheets

A – A

B – B

MONOLITHIC MICROWAVE INTEGRATED CIRCUIT RECEIVING DEVICE HAVING A SPACE BETWEEN ANTENNA ELEMENT AND SUBSTRATE

BACKGROUND OF THE INVENTION

1. Field of the Invention

This invention relates to a device for receiving on the ground microwaves from communication satellites, broadcasting satellites.

2. Related Background Art

Accompanying the recent rapid development of information network systems, the demand for satellite communication and broadcasting systems has rapidly increased, and frequency bands are becoming higher. In order to break through the limitation of the characteristics in Si bipolar transistor, a compound semiconductors, especially Schottky barrier field effect transistor consisting of GaAs (MESFET) has been practically used as a field effect transistor. In addition, to smaller-size the systems, reduce their prices and improve their performance, recently the integration (MMIC: Microwave Monolithic Integrated Circuit) of downconverter for converting higher frequencies to lower frequencies is being advanced.

As the antenna for directly receiving microwave signals from communication satellites and broadcasting satellites, the so-called parabolic antenna which collects electromagnetic waves by a parabolic reflecting mirror is the best in terms of efficiency and is presently most popular. On the other hand, an antenna comprising a plurality of antenna elements arranged in plane, and signal powers received by the respective elements are collected by a transmission line is called planar antenna. Owing to the improvement of the printing technique, planar antennas which are applicable to the microwave band have been available. Initially the planar antenna was far behind the parabolic antenna in terms of performance and costs. But the planar antenna has been increasing more studied since the latter half of 1970's, and the performance of the print board for microwaves has been improved. Presently the planar antenna has reached practical level.

As described above, there is possibility that the planar antenna, owing its plane structure, is able to be integrated monolithically on one and the same compound semiconductor substrate with a receiving unit to be connected to the planar antenna, i.e., a low noise amplifying circuit for amplifying a microwave signal received by the planar antenna, a frequency converting circuit for downconverting a frequency of the microwave signal amplified by the low noise amplifying circuit, a circuit for amplifying a downconverted middle-frequency signal, etc. If this integration is realized, it will be possible to reduce the size of the antenna system and simplify the connection of the antenna with the receiving unit. In addition, if the antenna can be integrated by a conventional manufacturing process for integration circuit, it will be advantageous in terms of the fabrication cost.

SUMMARY OF THE INVENTION

An object of this invention is to provide a receiving device comprising an antenna element, and a receiving unit connected to the antenna element, which are formed on a single substrate.

The GaAs substrate on which the receiving unit is integrated has a dielectric constant as high as 12.9. Consequently, if a patch antenna is formed directly on the substrate as the antenna element of the planar antenna, the frequency band of the planar antenna cannot be widened.

As a countermeasure to this, in the receiving device according to one aspect of this invention, the planar antenna is integrated on a single compound semiconductor substrate on which is formed the receiving unit to be connected to the planar antenna. But a patch antenna as the antenna element of the planar antenna is formed not directly on the compound semiconductor substrate but partially supported by a dielectric to be spaced from the substrate.

The frequency band of the planar antenna formed on a substrate directly is proportional to the thickness of a substrate, and is inversely proportional to the dielectric constant $\epsilon$. Accordingly the planar antenna is formed on a GaAs substrate of a high dielectric constant $\epsilon$ not directly but with a space, so as to obtain a wide frequency band.

In the receiving device according to another aspect of this invention, an inductor antenna comprising a helix formed by a first wire-layer and a second wire-layer.

This inductor antenna can be formed monolithically on the same substrate with the receiving unit. The inductor antenna and the receiving unit can be connected by a microstrip line. Consequently the receiving device size can be reduced and lightened. The antenna element, the receiving unit and the microstrip line can be integrated by standard integration techniques.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DESCRIPTION OF THE PREFERRED EMBODIMENT

A first embodiment of this invention will be explained with reference to FIGS. 1 to 3.

Figure 1:
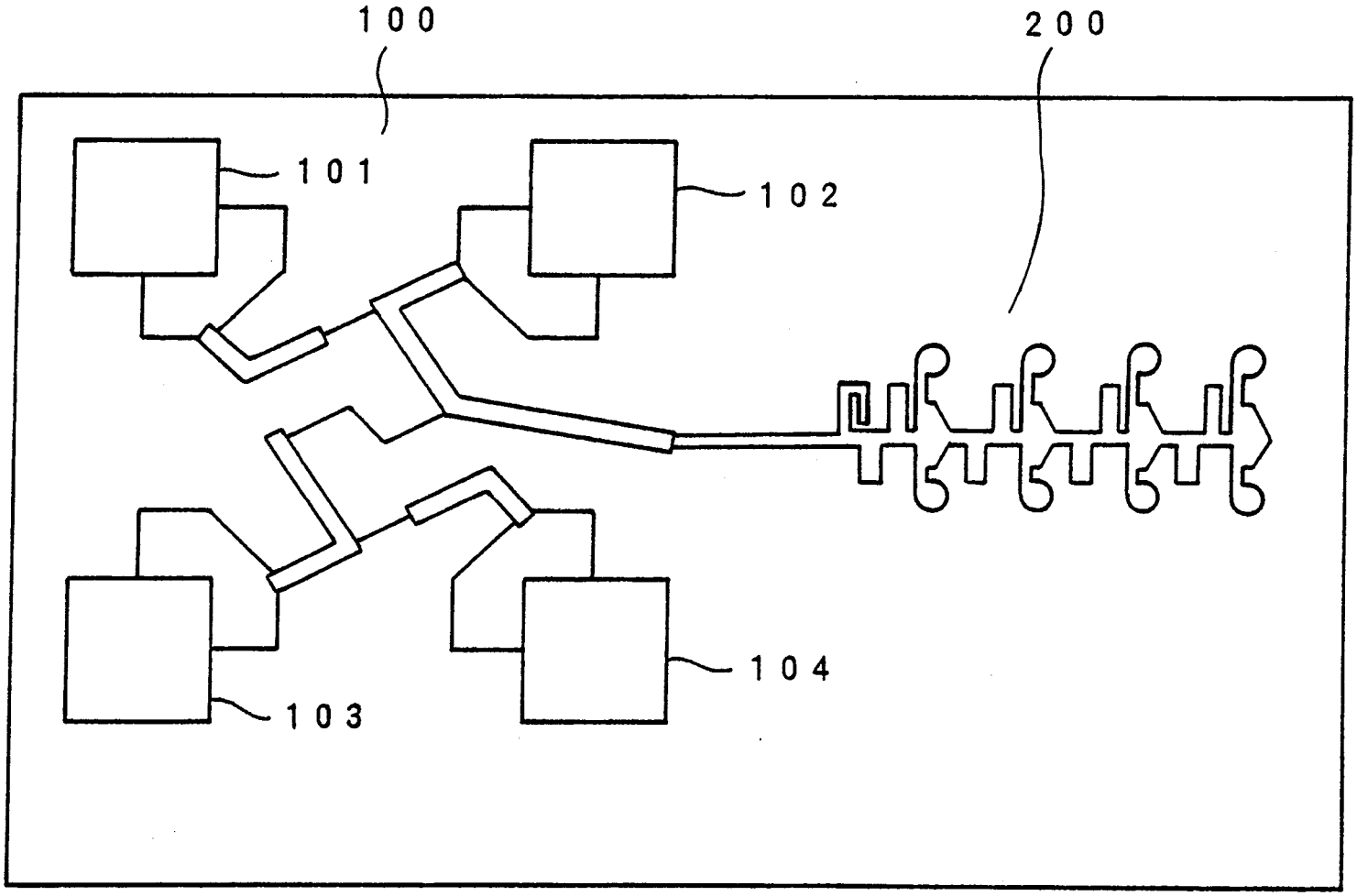
FIG. 1 is a plan view of the receiving device according to a first embodiment of this invention.

The receiving device according to a first embodiment of this invention, as shown in FIG. 1, has a planar antenna 100 including four patch antenna elements monolithically integrated with a receiving unit 200, which is constructed by a low noise amplifier for a receiving frequency band.

Figure 2:
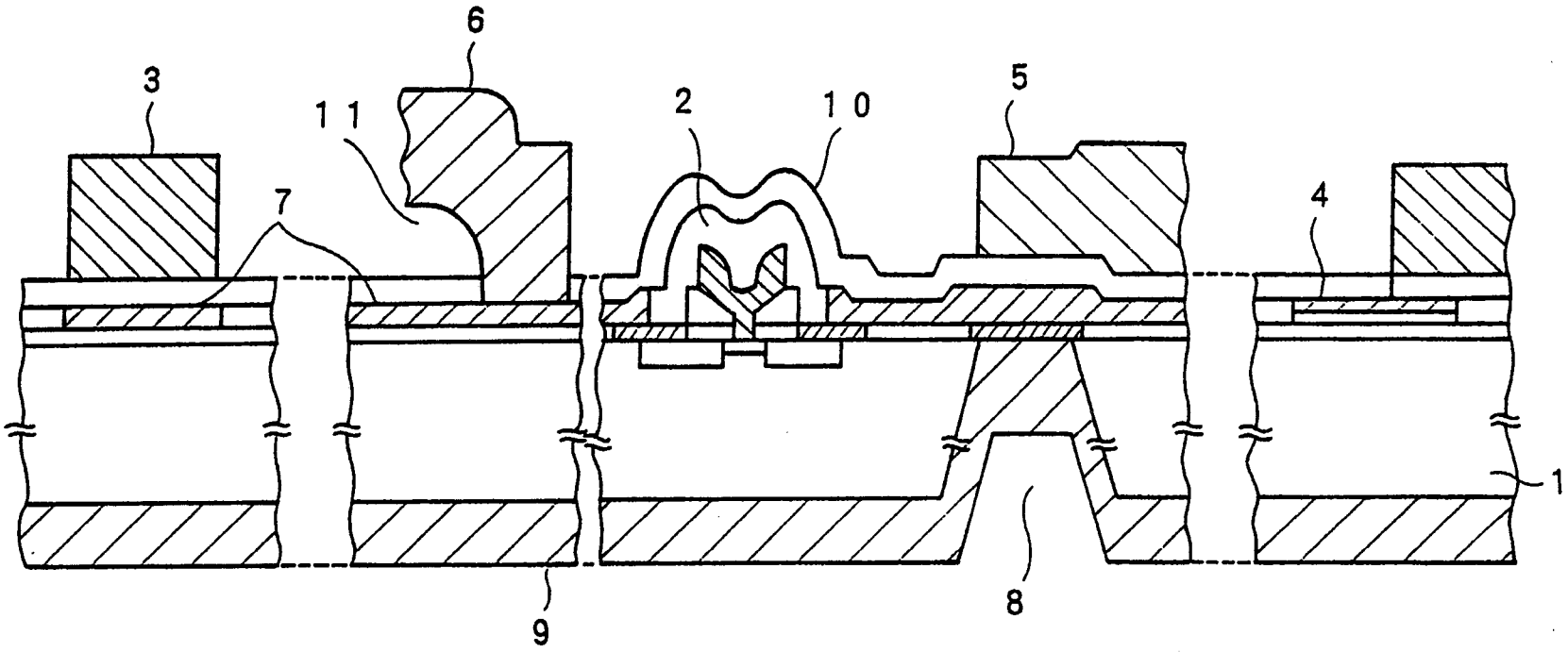
FIG. 2 is a sectional view of the receiving device according to the first embodiment.

FIG. 2 shows the partial sectional structures of the respective units of the receiving device. On the surface of a semi-insulating GaAs substrate 1 there are formed components of the receiving unit 200, such as an FET 2, an MIM capacitor 3, a metal resistor 4, a microstrip line 5, etc. A metal film 6 constituting patch antennas 101~104 which are antenna elements of the planar antenna 100 is also formed on the surface and is connected to the above-described circuit components by a first layer-metal line 7. The entire backside of the GaAs substrate 1 is covered by a metal layer 9 which is a grounding conductor of the receiving unit 200. This metal layer 9 is connected to the first layer-metal line 7 suitably by a via hole 8. Reference numeral 10 indicates a protective film of SiON.

Figure 3A:
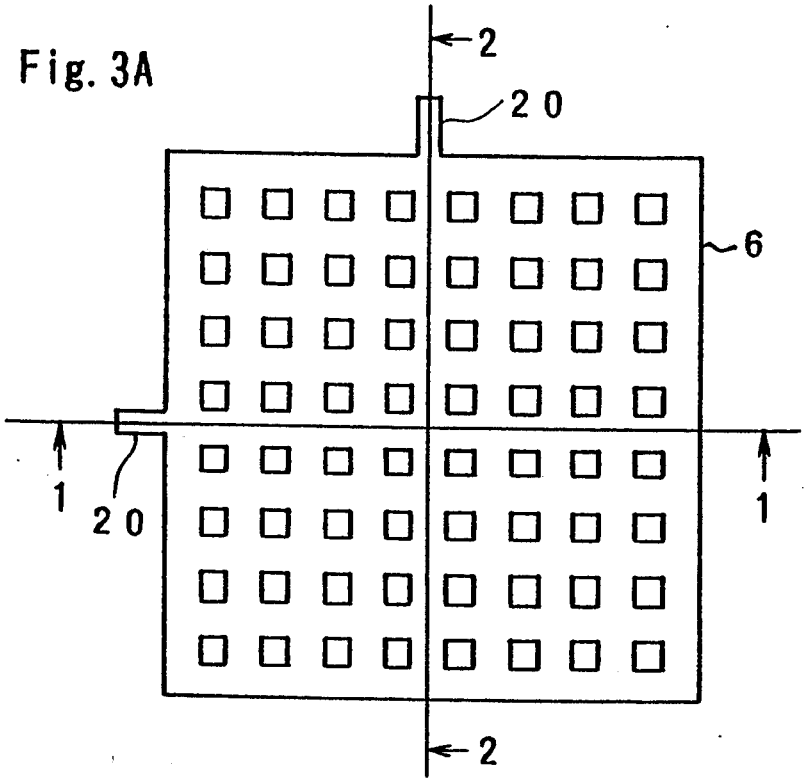
FIGS. 3A to 3C are a plan view, and sectional views an arrangement of dielectric posts for supporting a meshed patch antenna as an element of the planar antenna involved in the receiving device according to this invention along 1—1 and 2—2 lines in FIG. 3A.
Figure 3B:
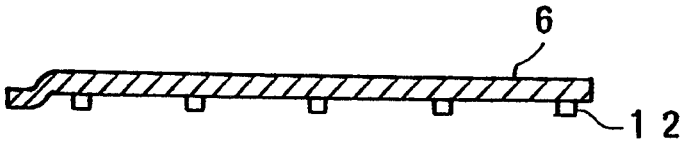
Figure 3C:
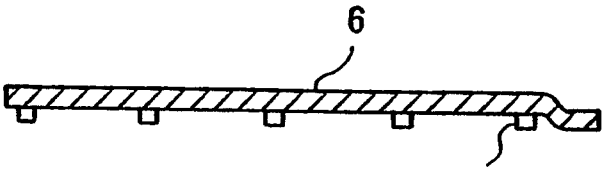
Figure 4:
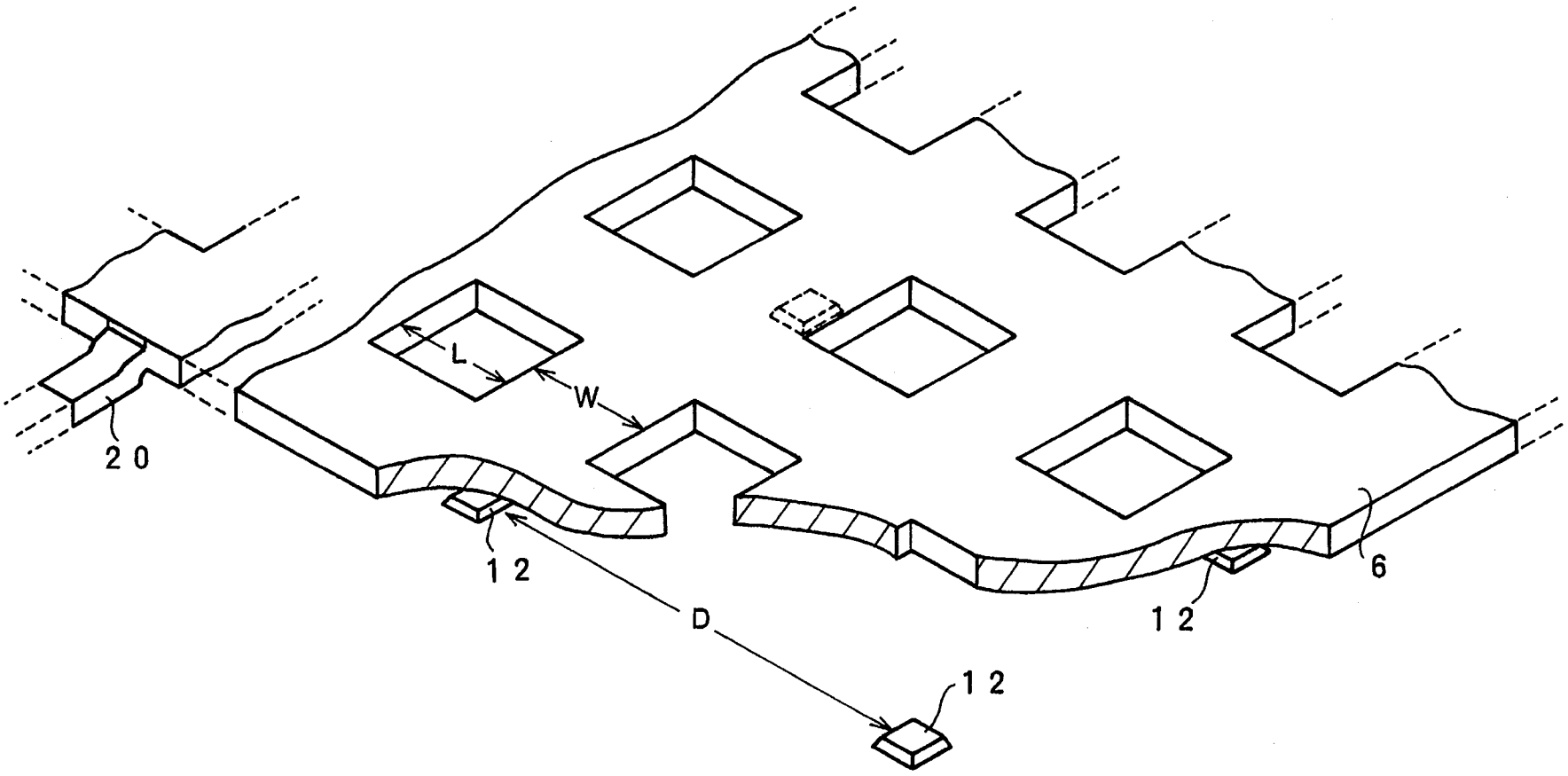
FIG. 4 is a partially broken perspective view of the meshed patch antenna showing a structure thereof.

The respective patch antennas 101~104 have an air bridge structure. That is, the metal film 6 constituting the patch antennas 101~104 is formed not directly on the surface of the GaAs substrate 1 but is with a space 11. The metal film 6 is partially supported for mechanical strength by dielectric posts made of SiN, $SiO_2$ or others, but there is a void between a most part of the metal film 6 and the GaAs substrate 1. In FIG. 1 the patch antennas 101~104 are plane but may be meshed to facilitate the construction of the air bridge structure and to reduce their own weight. FIG. 3A is a plan view of the antenna element in the form of a meshed patch antenna formed by forming a number of openings in a rectangular patch antenna. FIGS. 3B and 3C are the sectional yields of the meshed antenna element of FIG. 3A along lines 1—1 and 2—2. FIG. 4 is a perspective view of the meshed patch antenna partially broken. As shown in these figures, the metal film 6 constituting the patch antennas is supported by a number of dielectric posts 12 spaced from one another on the GaAs substrate 1. These patch antennas are of a double-feed type, that is each patch antenna is connected at two positions to a connection line 20 on the GaAs substrate 1. By forming the meshed patch antennas, the interval between the dielectric posts 12 can be accordingly widened consequently reducing the weight of the metal film 6. Although it depends on forming processes and materials, the above-described meshed patch antenna can be easily made if the line width W and one side of each opening of the mesh is about 10~20 μm, which are negligible with respect to the wavelengths of the microwave band, and an interval D between dielectric posts 12 is 100~200 μm.

Figure 5A:
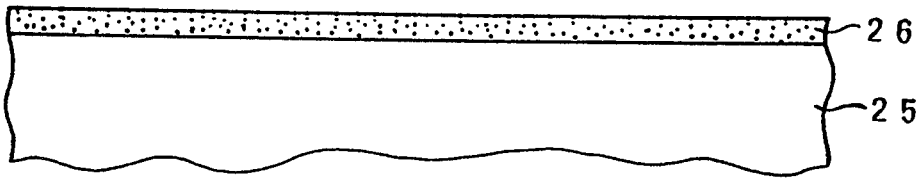
FIGS. 5A to 5E are sectional views explaining the steps for making the meshed patch antenna.
Figure 5B:
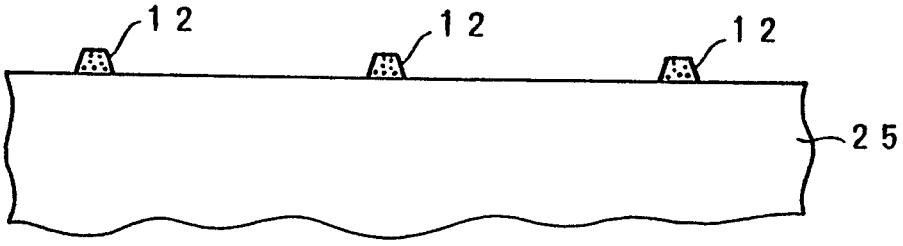
Figure 5C:
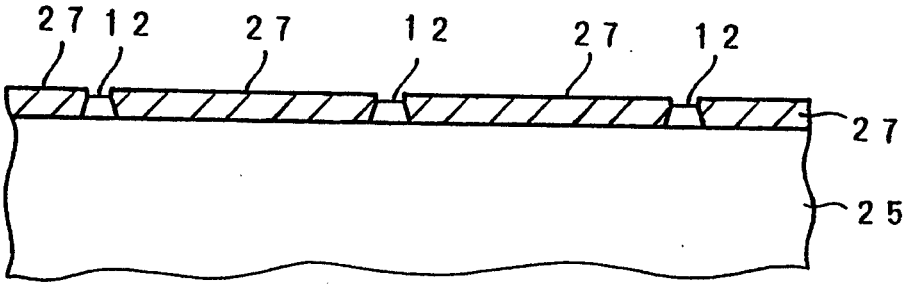
Figure 5D:
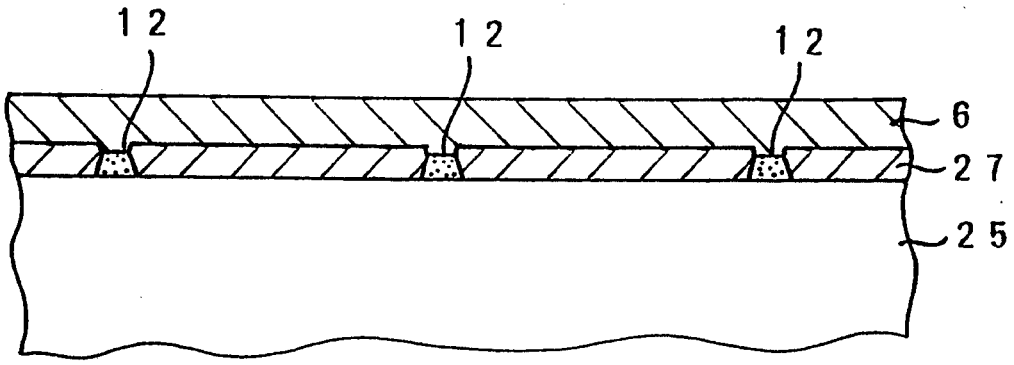
Figure 5E:
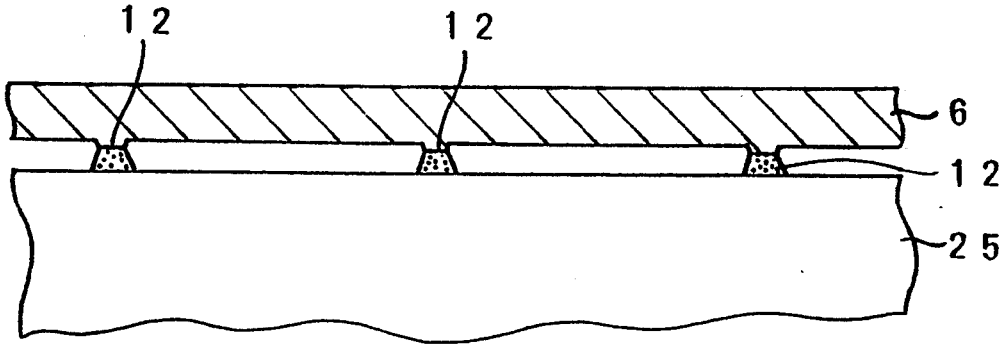

FIGS. 5A to 5E are sectional views of the steps for forming the patch antenna. First, an $SiO_2$ film 26, for example, as a material of the dielectric posts 12 is deposited on a substrate 25 in an about 1 μm-thickness (FIG. 5A). Then those parts of the $SiO_2$ film 26 that are not necessary are removed by photolithography to form a plurality of the dielectric posts 12 (FIG. 5B). Next a photoresist is applied to the entire surface and patterned to form openings in parts corresponding to the dielectric posts 12. The thickness of the photoresist 27 is substantially the same as the height of the dielectric posts 12. (FIG. 5C). Then a metal film 6 is formed by plating on the entire surface and patterned into a required shape (FIG. 5D) for meshed patch antennas. Finally the photoresist 27 is melted off, and the meshed patch antennas have an air-bridge structure (FIG. 5E). Because the patch antenna is patterned in a mesh as in FIG. 4, in the step of melting off the photoresist 27, a solvent enters also through the openings. Accordingly, the air bridge structure can be rapidly formed.

Figure 6:
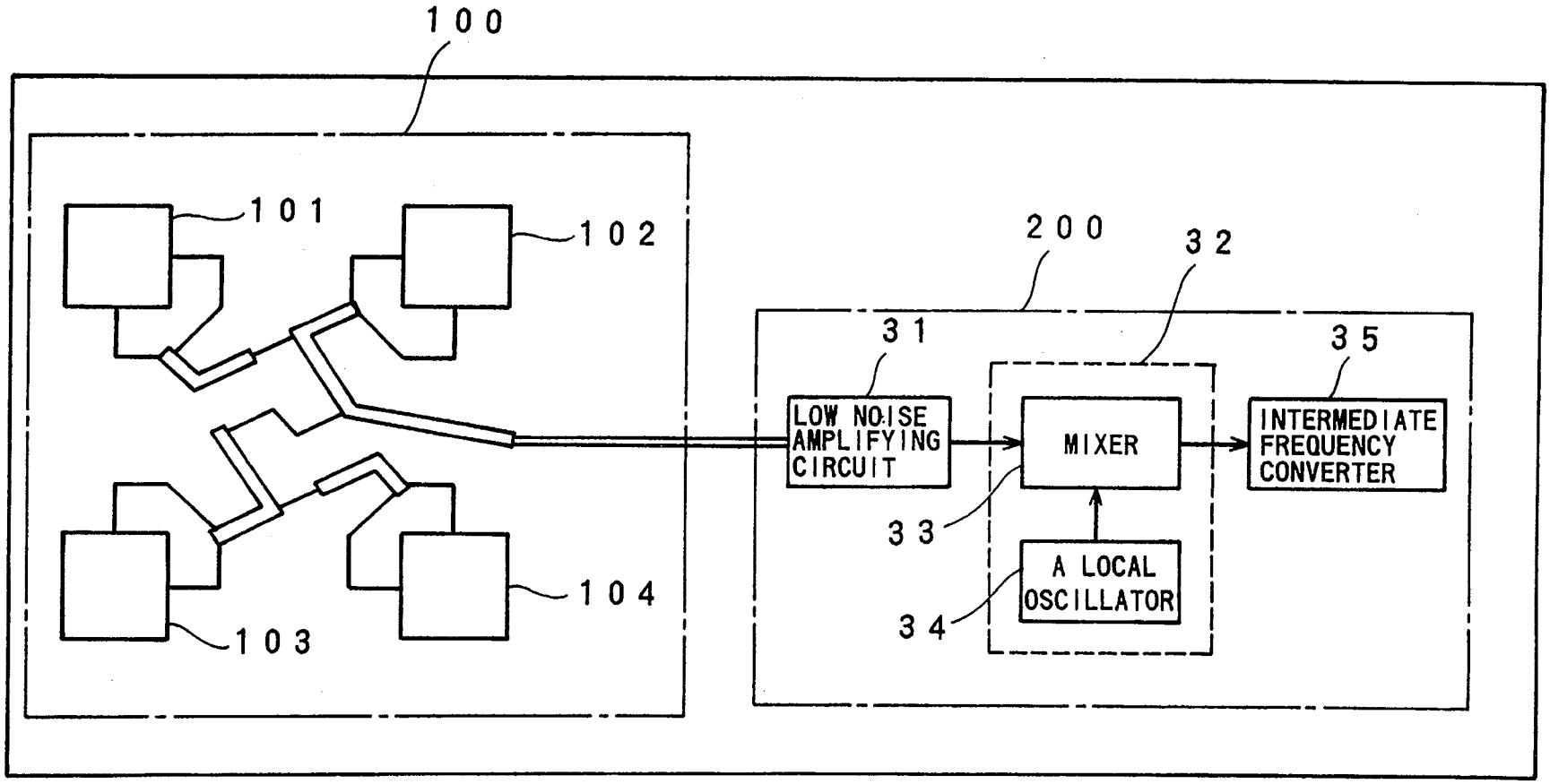
FIG. 6 is a plan view of an example of the receiving unit that includes a frequency converter and an intermediate frequency amplifying circuit in addition to a low noise amplifying circuit.

The receiving unit 200 as shown in FIG. 6, comprises not only the low noise amplifying circuit 31 for amplifying a high-frequency signal, but also a frequency converting circuit 32 and an intermediate-frequency amplifying circuit 35. The frequency converting circuit 32 mixes at a mixer 33 a high-frequency signal from the low noise amplifying circuit 31, and a signal from a local oscillator 34 to convert the high-frequency signal into an intermediate-frequency signal.

It is also possible that a phase shifter circuit for shifting a phase of the received microwave signal be integrated in receiving unit 200 for use in systems which can electronically trace the the direction of a communication satellite or broadcasting satellite for receiving microwave signals from the satellite in mobile objects, such as automobiles, on the ground.

In this embodiment, the antenna element is in the form of a square patch antenna. As is well known, the patch may have various shapes and naturally is not limited to squares. Antenna elements other than the patch antenna, such as line-shaped, spiral and slot-shaped antenna elements, can be optionally used.

Figure 7:
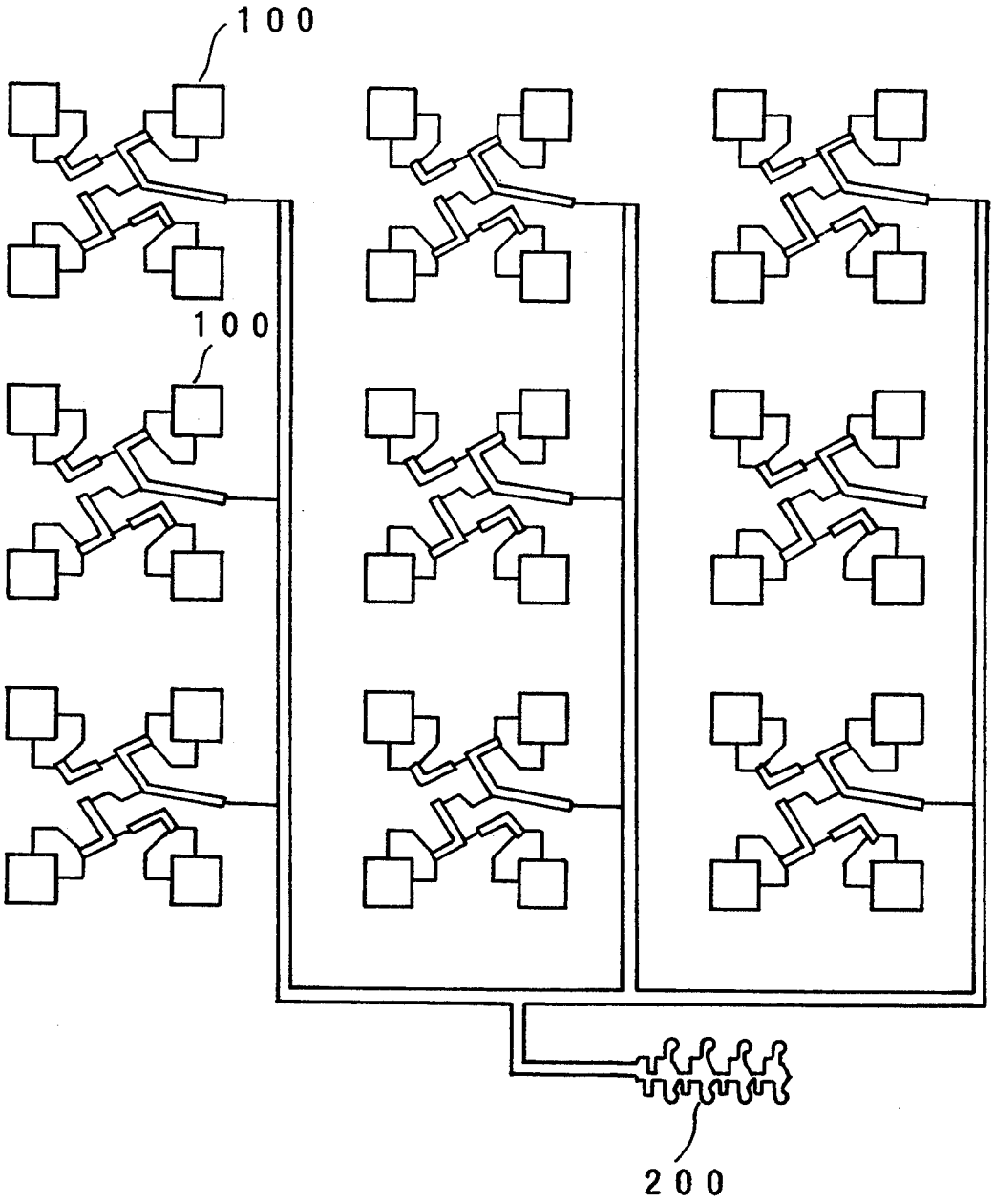
FIG. 7 is a plan view of the receiving device according to a second embodiment of this invention.

FIG. 7 shows a second embodiment of this invention. In this embodiment, a number of the planar antenna shown in FIG. 1 are integrated. It is possible to increase the number of the element up to a limit of a wafer size.

Figure 8:
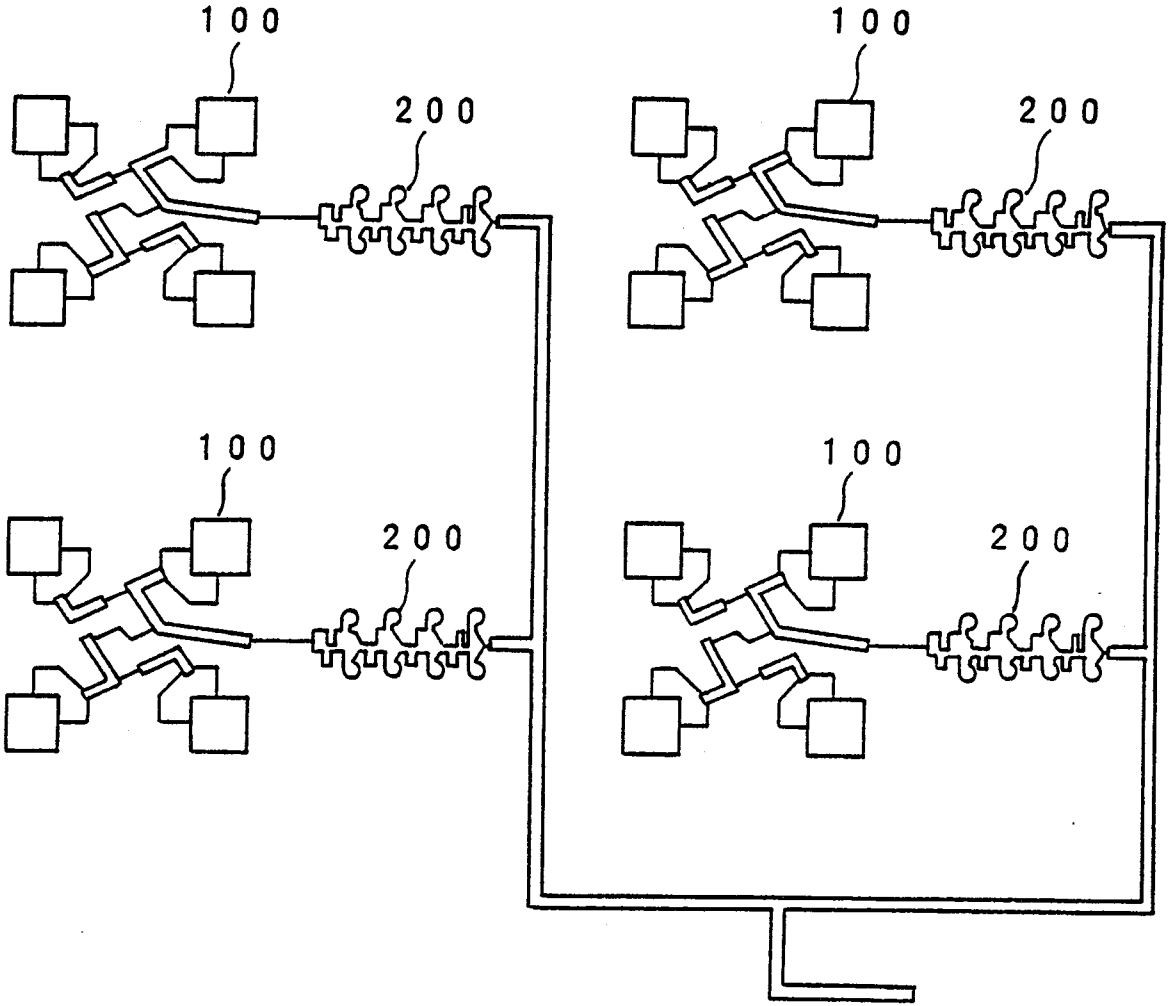
FIG. 8 is a plan view of the receiving device according to a third embodiment of this invention.

FIG. 8 shows a third embodiment of this invention. In this embodiment, one set of the planar antenna 100 and the receiving unit 200 consisting of a low noise amplifying circuit 73, that is the receiving unit of FIG. 1 is used as an array element, and a plurality of the array elements are arranged in a plane. One factor of the fact that the efficiency of the planar antenna cannot be easily improved in comparison with the parabolic antenna is large loss in the feed system. The noise figure can be improved by adding a low noise amplifier to each antenna element as in this embodiment. In the embodiment of FIG. 8, receiving devices of FIG. 1 are integrated monolithically on a single GaAs substrate. Needless to say, the same advantageous effect can be achieved by hybrid integration of a plurality of receiving devices of FIG. 1 on a substrate of a dielectric, such as foamed polyethylene, having a low dielectric constant and a small tan δ which are suitable to the planar antenna.

Figure 9:
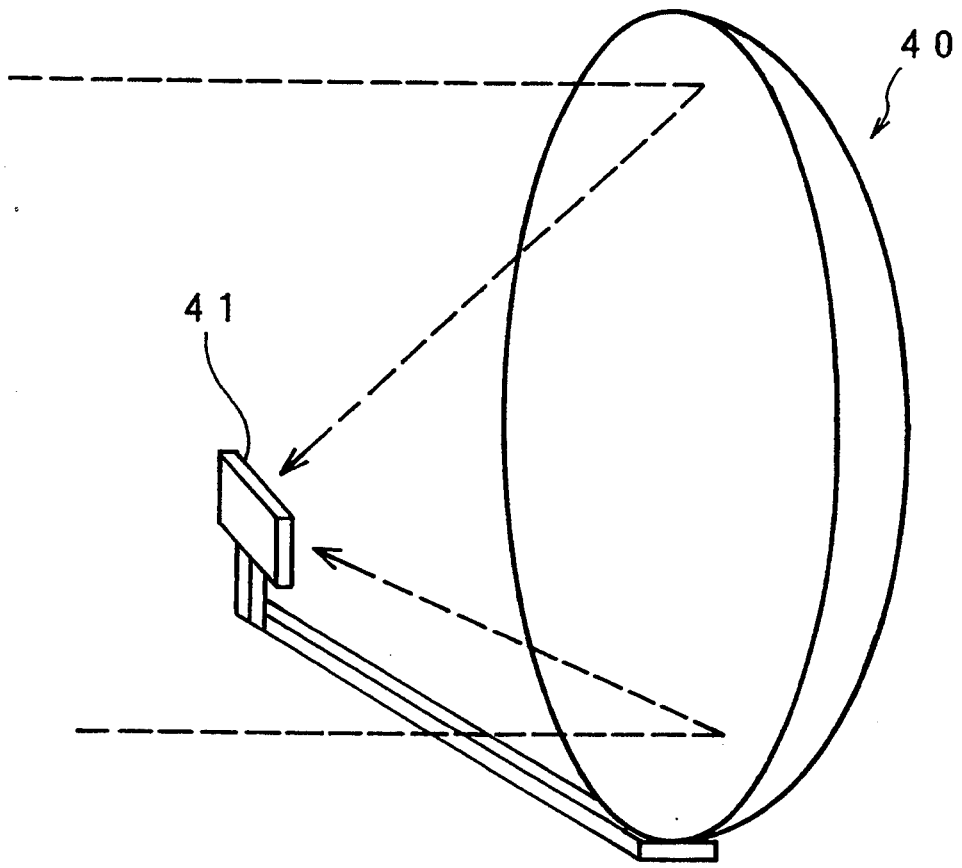
FIG. 9 is a diagrammatic view of the receiving device according to a fourth embodiment of this invention in which the receiving device is used as the primary horn of a parabolic antenna.

It is possible to use this integrated circuit as a primary horn 41 of the parabolic antenna 40 as in FIG. 9. Consequently the box-shaped converter presently used can be replaced by a thin, ultra-small one.

Figure 10:
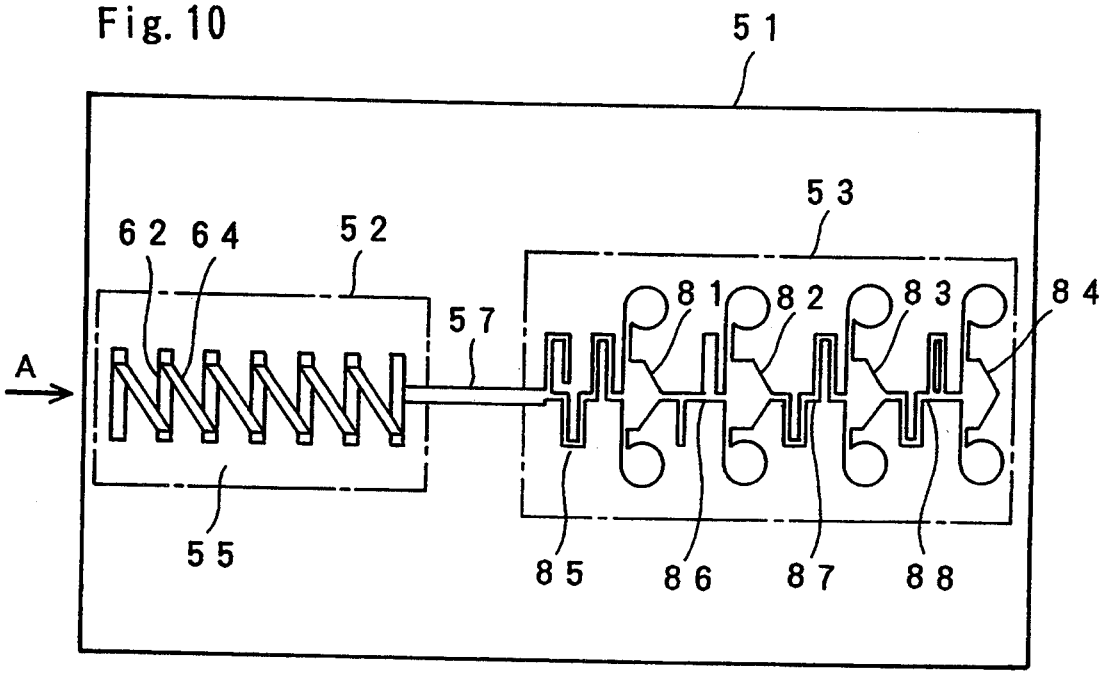
FIG. 10 is a plan view of the receiving device according to a fifth embodiment of this invention.

FIG. 10 is a plan view of the receiving device according to a fifth embodiment of this invention. A GaAs semiconductor layer is formed on the surface of a GaAs substrate 51, a semi-insulating semiconductor substrate by epitaxial growth. On the GaAs substrate 51 there are provided an antenna unit 52 and a receiving unit 53. Both are electrically connected to each other by microstrip line 57. The receiving unit 53 is specifically a low noise amplifier. The low noise amplifier 53 includes an MESFET, etc. formed on the one or more epitaxial semiconductor layers which are grown on the semiconductor substrate 51. This low noise amplifier is a four-stage amplifying circuit, and includes amplifying units 81~84 and impedance matching circuits 85~88.

The antenna unit 52 comprises inductor elements 55 having a three-dimensional helical structure on the GaAs substrate 51. Its forming process will be explained with reference to FIGS. 11 to 13.

Figure 11:
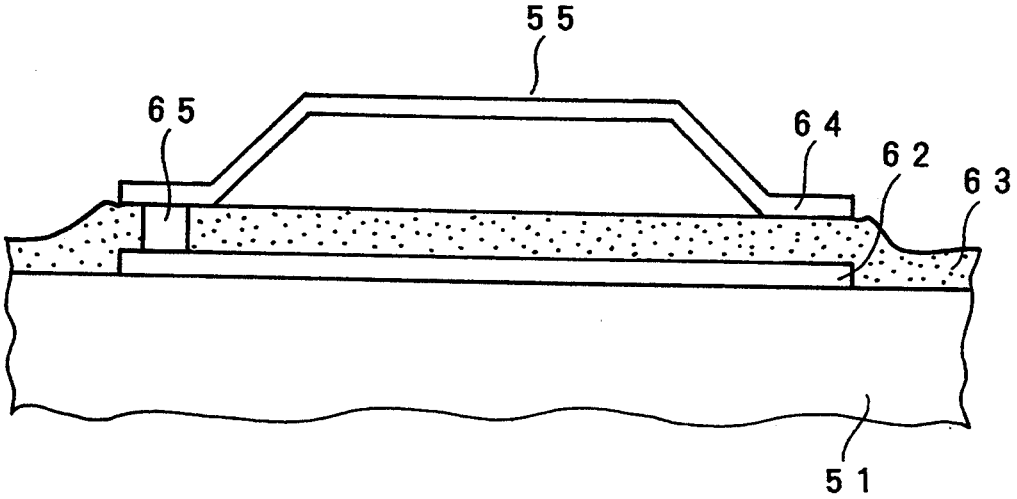
FIG. 11 is a sectional view of an inductor element as the antenna used in the fifth embodiment.
Figure 12:
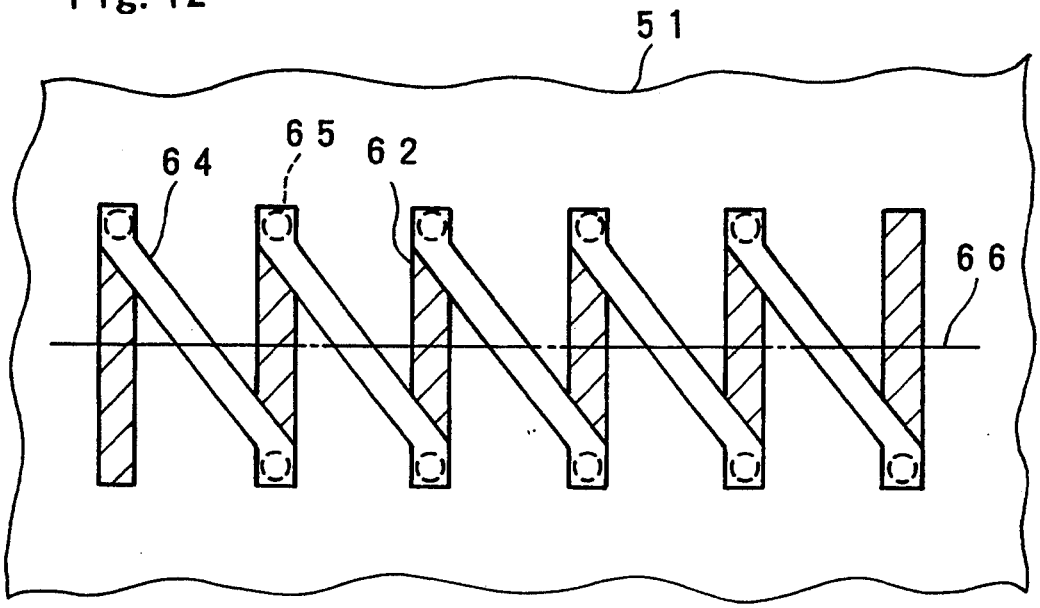
FIG. 12 is a plan view of the inductor element of FIG. 11.
Figure 13:
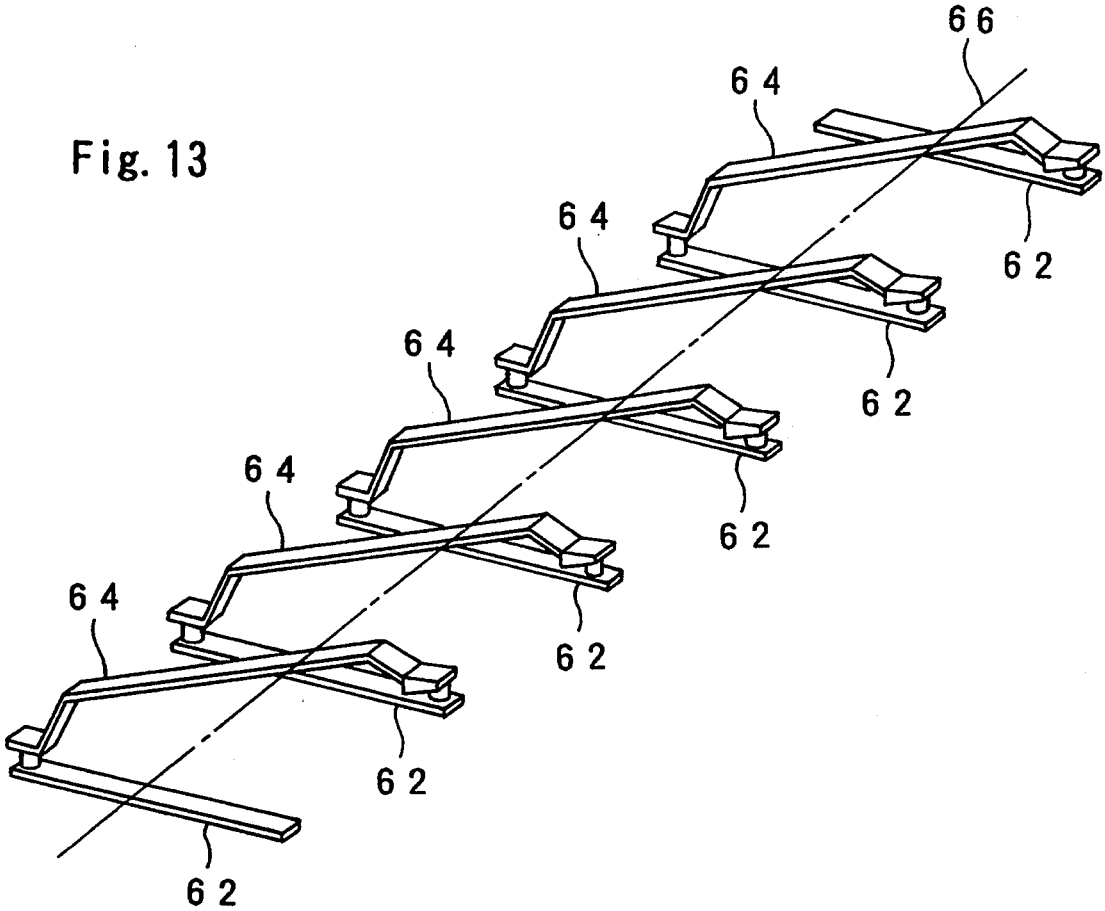
FIG. 13 is a perspective view of the inductor element of FIG. 11.

FIG. 11 is a sectional view of each inductor element 55 involved in this embodiment. FIG. 12 is a plan view of the inductor element 55. FIG. 13 is a perspective view of the inductor element 55. A plurality of first-layer lines 62 in the form of, e.g., 2 μm-width and 50 μm-length strips are arranged along a required phantom line 66 so that the individual first-layer lines intersect the phantom line. The first-layer lines 62 are made of a metal, such as Ti/Au or others, and has a thickness of 0.5~μm.

Then an inter-layer insulating film 63, as of $Si_3N_4$ SiON or others, is formed normally in a thickness of thousands of Angstroms. Subsequently those parts of the inter-layer insulating film 63 for contact holes to be formed are etched off, and through-holes are formed.

Next, a photoresist is applied in a thickness as large as possible which does not hinder exposure and development. Depending on kinds of the photoresist and its application conditions, it is possible to apply the photoresist in a thickness of about 20 μm. Then those parts of the photoresist corresponding to the contact holes 65 are removed by exposure and development so that a second-layer line 64 to be formed later can be electrically coupled to the appropriate adjacent first-layer line 62. After this patterning is over, the top end of the photoresist is rounded by baking at a temperature a little higher than usual, or 140° C. This rounded top end facilitates the formation of the conductors of the second-layer lines 64. A metal, such as Ti/Au or others, is applied by vaporization or sputtering, and furthermore Au is plated thereto. And the second-layer lines 64 are formed. The thickness of the second-layer lines 64 is usually 2~3 μm. Following this formation of the second-layer lines 64, the photoresist is removed, and an air bridge is formed between the first-layer lines 62 and the second-layer lines 64. But the inter-layer insulating film 63 remains on the first-layer lines 62.

Following the above-described steps, the inductor element 55 having a helical structure constituted by the first-layer lines 62, the second-layer lines 64 and the contact holes 65 is completed.

The inductor element can be formed without using the air bridging technique. For example, the inter-layer insulating film 63 is formed thicker, and the second-layer lines 64 are formed directly on the film 63. The use of the air bridging structure has the following two advantages. The larger a sectional area, the larger the inductance value, consequently the inductor element having an air bridge structure can have a smaller plane area for the same inductance value. Accordingly, by making the sectional area larger by using are air bridge structure, the size of the MMIC can be reduced. In addition, by making a larger void between the first-layer lines 62 and the second-layer lines 64, the distribution capacity is smaller, and as the result the self resonance frequency becomes high, i.e., a maximum limit frequency usable as the inductor unit in this element increases.

The fabricated inductor element 55 is electrically connected to the receiving unit 53 by a microstrip line 57 on the same substrate, and a light, small, receiving device which is easy to handle can be fabricated. The antenna of this receiving device is structurally arranged to receive electromagnetic waves in the direction indicated by the arrow A in FIG. 10. Thus, the receiving device receives electromagnetic waves parallel with the surface of the substrate 51. This has the following advantages. Here it is assumed that the inductor element 55 is replaced by a patch antenna element. Then the receiving device receives electromagnetic waves in the direction perpendicular to the surface of the substrate 51. Under the influence of the electromagnetic waves at the front of the receiving device the receiving unit 53 is apt to make erroneous operations. But these problems do not occur in the case of this embodiment where electromagnetic waves are received in a direction parallel with the surface of the substrate 51.

In this embodiment, the receiving unit 5S is a low noise amplifier. But together with the low noise amplifier, a frequency converting circuit for downconverting a frequency of an output signal, an intermediate frequency amplifying circuit for amplifying the output signal of the frequency converting circuit, etc. may be integrated.

In the case that this receiving device is applied to a mobile object, such as an automobile, it is preferable that means for electronically tracing the direction of a communication satellite or broadcasting satellite for receiving microwave signals from the satellite, i.e., a phase shifter circuit for shifting a phase of a received microwave signal is built into the receiving unit 53.

Figure 14:
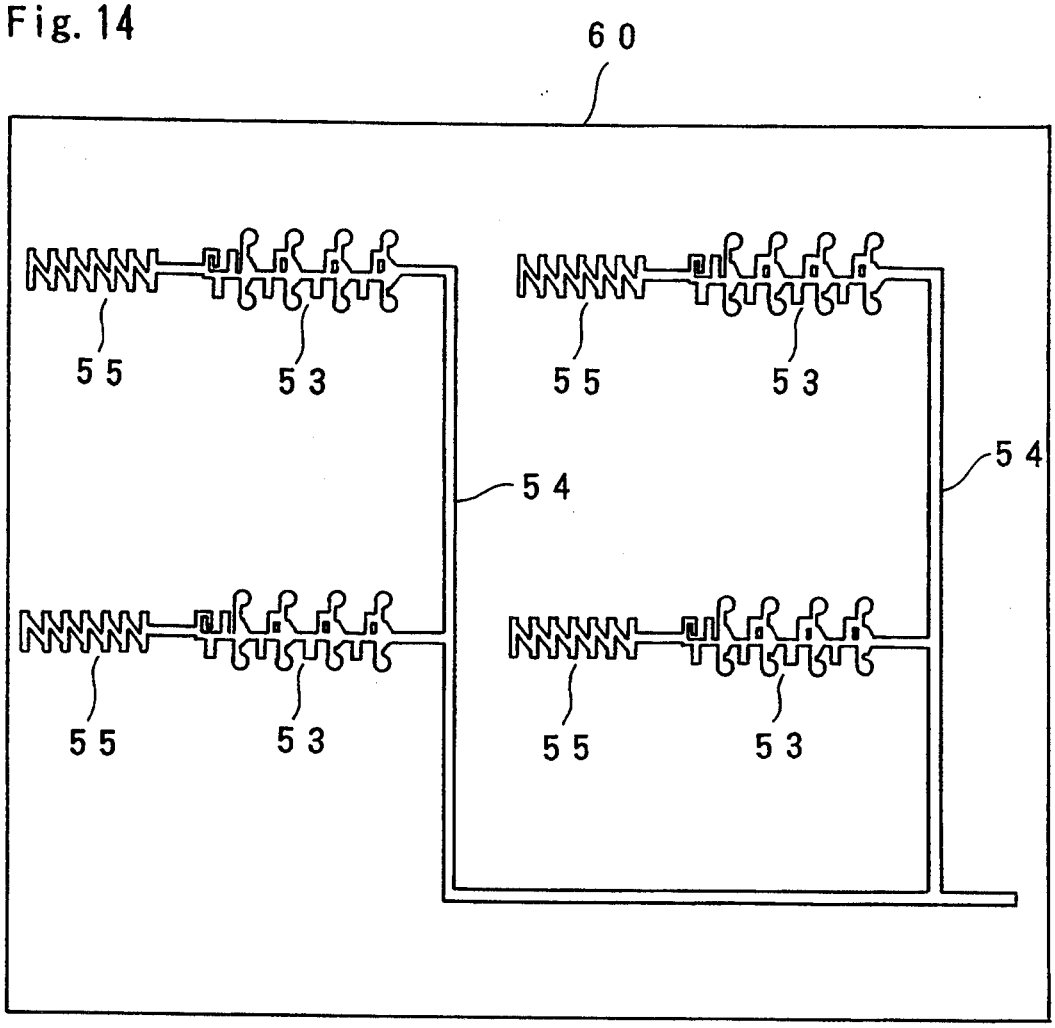
FIG. 14 is a plan view of the receiving device according to a sixth embodiment of this invention.

FIG. 14 is a plan view of the receiving device according to a sixth embodiment of this invention. In this receiving device, four inductor elements 55 as the antenna unit, and four low noise amplifiers 53 as the receiving unit are arranged in arrays on a semi-insulating semiconductor substrate 60. Each inductor element 55 is connected to one of the low noise amplifiers 53. The output terminals of the low noise amplifiers 53 are connected to one another by a common microstrip line 54. The output terminals of the respective low noise amplifiers 53 are connected to one another commonly by the microstrip line 54 so that signals received by the respective antennas are synthesized with maximum efficiency. Generally a factor for the fact that the efficiency of the planar antenna does not easily go up is large loss in the feeding system. But the noise factor can be greatly reduced by adding a low noise amplifier 53 to each inductor element 52 as in this embodiment.

The above-described the fifth and sixth embodiments are those of a receiving device for receiving microwaves directly from communication satellites and so on, but it is possible to use this receiving device as a primary horn of a parabolic antenna.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. A microwave receiving device comprising:

a semiconductor substrate;

a plurality of first-layer lines formed on said semiconductor substrate in parallel with each other, each of said first-layer lines having a first end and a second end;

an insulating film formed on said semiconductor substrate and on said first-layer lines except at regions of said first end and said second end;

a plurality of second-layer lines provided above said insulating film in parallel with each other, each of said second-layer lines connecting said first end of one of said first-layer lines with a said second end of an adjacent one of said first-layer lines whereby said first-layer lines and said second-layer lines form a helical antenna;

a transmission line; and a receiving unit formed on said semiconductor substrate and connected to said helical antenna by said transmission line.

2. A microwave receiving device according to claim 1, wherein said second-layer lines and said insulating film form spaces therebetween.

3. A microwave receiving device according to claim 1, wherein said second-layer lines and said insulating film define spaces therebetween.

4. A microwave receiving device according to claim 1, wherein said substrate includes a semi-insulating compound semiconductor substrate and a semiconductor layer epitaxially grown on said semi-insulating compound semiconductor substrate.

5. A microwave receiving device according to claim 4, wherein said semi-insulating semiconductor substrate is a semi-insulating GaAs substrate.

6. A microwave receiving device according to claim 1, wherein said first-layer lines and said second-layer lines are electrically conductive films.

7. A microwave receiving device according to claim 6, wherein said electrically conductive film is a metal film.

8. A microwave receiving device according to claim 1, wherein said insulating film is formed of $SiO_2$ or SiN.

9. A microwave receiving device according to claim 1, wherein said receiving unit includes a low noise amplifying circuit for amplifying a signal received by said helical antenna.

10. A microwave receiving device according to claim 9, wherein said receiving unit further includes a frequency converting circuit for converting a high-frequency signal amplified by said low noise amplifying circuit into an intermediate-frequency signal.

11. A microwave receiving device according to claim 10, wherein said receiving unit further includes an amplifying circuit for amplifying an intermediate-frequency signal from said frequency converting circuit.

12. A microwave receiving device according to claim 1, wherein said receiving includes a phase shifting circuit for phase shifting a signal received by said helical antenna.

13. A microwave receiving device according to claim 1, further comprising a parabolic antenna, electromagnetic waves received by said parabolic antenna being collected and supplied to said helical antenna.

14. A microwave receiving apparatus comprising:

a dielectric substrate;

a plurality of microwave receiving devices, each of said microwave receiving devices comprising a semiconductor substrate arranged on said dielectric substrate;

a plurality of first-layer lines formed on said semiconductor substrate in parallel with each other, each of said first-layer lines having a first end and a second end, an insulating film formed on said semiconductor substrate and on said first-layer lines except at regions of said first end and said second end, a plurality of second-layer lines provided above said insulating film in parallel with each other, each of said second-layer lines connecting said first end of one of said first-layer lines with said second end of an adjacent one of said first-layer lines whereby said first-layer lines and said second-layer lines form a helical antenna, a transmission line, and a receiving unit formed on said semiconductor substrate and connected to said helical antenna by said transmission line; and a microstrip line formed on said dielectric substrate for connecting a plurality of said microwave receiving devices.

15. A microwave receiving apparatus according to claim 14, wherein said second-layer lines and said insulating film define spaces therebetween.

16. A microwave receiving apparatus according to claim 14, wherein said dielectric substrate has a smaller dielectric constant and tan $\delta$ than GaAs.

17. A microwave receiving apparatus according to claim 14, wherein said electric substrate is foam polyethylene.

* * * * *